United States Patent [19]

Hussey et al.

[11] 4,323,902

[45] Apr. 6, 1982

[54] POWER ANTENNA WITH RESILIENT MOUNTING MEANS

[75] Inventors: James L. Hussey, Centerville; Michael B. Miller, Bellbrook; William C. Staker, Jr., Springfield, all of Ohio

[73] Assignee: General Motors Corporation, Detroit, Mich.

[21] Appl. No.: 193,659

[22] Filed: Oct. 3, 1980

[51] Int. Cl.[3] ..... H01Q 1/10

[52] U.S. Cl. ..... 343/903; 343/901

[58] Field of Search ..... 343/900, 715, 903, 901; 174/153 A, 175

[56] References Cited

U.S. PATENT DOCUMENTS

| | | | |
|---|---|---|---|
| 3,253,799 | 5/1966 | Till | 343/903 |
| 3,893,125 | 7/1975 | De Bellomayre | 343/903 |
| 4,153,825 | 5/1979 | Flora | 343/903 |
| 4,181,268 | 1/1980 | Carolus et al. | 343/903 |
| 4,183,026 | 1/1980 | Buchanan, Jr. et al. | 343/715 |
| 4,236,162 | 11/1980 | Carolus et al. | 343/903 |

*Primary Examiner*—David K. Moore
*Attorney, Agent, or Firm*—Saul Schwartz

[57] ABSTRACT

An improved power actuated antenna installation, particularly for automotive vehicles, of the type including a mast jacket rigidly attached to body structure of the vehicle, a telescoping antenna disposed on the mast jacket, a power actuator disposed on an L-shaped housing with a first leg parallel to the mast jacket and a second leg below the mast jacket, and a flexible drive element projecting into the mast jacket through a guide bushing at the lower end thereof for attachment to the antenna and into the second leg of the housing for attachment to the actuator, the improvement residing in the provision of elastomeric grommets between a pair of pins on the mast jacket and a pair of rigid arms on the first leg of the housing and in the provision of a combination seal and grommet between the drive element and housing generally immediately below the mast jacket, the grommets and the combination seal and grommet effecting resilient support of the actuator on the mast jacket in a manner discouraging transmission of actuator vibration to the supporting body structure.

3 Claims, 5 Drawing Figures

POWER ANTENNA WITH RESILIENT MOUNTING MEANS

BACKGROUND OF THE INVENTION

1. Field of the Invention

This invention relates generally to power actuated accessories for vehicles and, more particularly, to an improved power actuated antenna installation for an automotive vehicle.

2. Description of the Prior Art

Generally, in power actuated accessory applications for vehicles, an accessory device such as a radio antenna, windshield wiper arm or the like is mounted on the vehicle body for movement in a prescribed path. Motive power for the accessory device is typically an electric motor secured to the vehicle body and connected to the accessory device through appropriate linkage. The combination of motor and linkage can, during operation, generate vibrations which may be magnified by the body structure to which the motor and/or linkage is attached and experienced within the passenger compartment as noise. To combat this noise transmission phenomenon numerous isolation systems have been proposed which have been, to varying degrees, successful. A power actuated antenna installation according to this invention incorporates a vibration isolation system which represents an improvement over heretofore known systems in similar applications.

Accordingly, the primary feature of this invention is that it provides an improved power actuated accessory installation for automotive type vehicles. Another feature of this invention is that it provides an improved power actuated accessory installation for vehicles particularly suited for radio antenna applications. A further feature of this invention is that it provides, in an automotive radio antenna application, an improved power actuated accessory installation incorporating a novel isolation mounting system for reducing the transmission of noise inducing vibration from the actuator power operator to the passenger compartment. A still further feature of this invention resides in the provision in the improved power actuated accessory installation, when embodied in a power antenna application, of an antenna mast assembly rigidly attached to body structure of the vehicle and a power actuator assembly supported on the mast assembly through isolation mounting means which discourage transmission of vibration of the actuator assembly to the mast assembly and supporting body structure. Yet another feature of this invention resides in the provision in the improved power actuated accessory installation, when embodied in a vehicular power antenna application, of a mast assembly including a mast jacket rigidly attached to body structure of the vehicle and an extendable antenna member on the mast jacket, in the provision of a flexible drive element connected to the antenna member and projecting out the lower end of the mast jacket through a guide bushing on the latter, and in the provision of an L-shaped actuator assembly having a generally vertical leg connected to the mast jacket intermediate the ends of the latter through a pair of elastomeric grommets providing primary vertical support for the actuator assembly and having a generally horizontal leg disposed below the mast jacket with the drive element projecting into the horizontal leg through a combination elastomeric seal and grommet located adjacent the guide bushing so that the seal and grommet cooperates with the drive element and guide bushing in resiliently resisting lateral displacement of the horizontal leg relative to the mast jacket. These and other features of this invention will be readily apparent from the following specification and from the drawings wherein:

Figure 1:
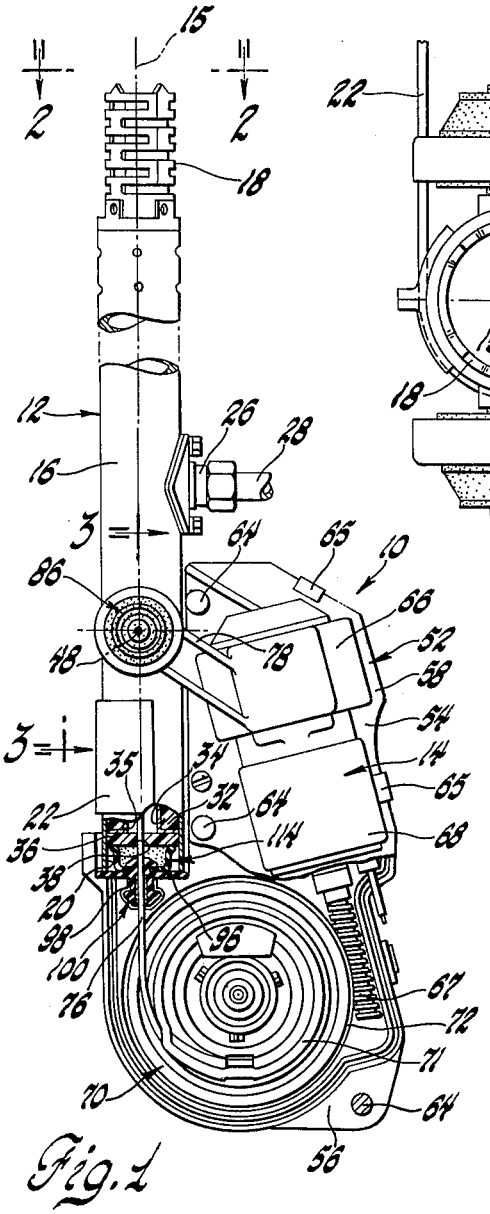
FIG. 1 is a partially broken away side elevational view of a vehicle accessory installation according to this invention embodied in a power actuated antenna application.

Referring now to FIG. 1 of the drawings, a power actuated accessory installation according to this invention and designated generally 10 is shown embodied in a power actuated radio antenna application for an automotive type vehicle. The accessory installation 10 includes a mast jacket assembly 12 and a power actuator assembly 14. The mast jacket assembly 12 has a longitudinal axis 15 and includes a housing tube 16 terminating at its upper end in a compressible mounting structure 18 and at its lower end in a circular opening 20. A flange 22 is rigidly attached to the housing tube 16 by conventional means, as by welding, generally adjacent the circular opening 20 at the lower end of the tube and includes an aperture 24 therethrough. The flange 22 provides one convenient appendage from which to support the mast jacket assembly on the vehicle body and to that end a conventional bolt type fastener, not shown, projects through the aperture 24 and functions to rigidly attach the flange 22 to an appropriate sheet metal portion of the body. At the opposite end of the housing tube, the collapsible mounting structure 18 functions to rigidly attach taht end of the mast jacket assembly to an appropriate body member, as for example a fender, and thereby cooperates with the flange 22 in rigidly attaching the mast jacket assembly to the vehicle body. The mounting structure 18 is shown and described in U.S. Pat. No. 4,183,026, issued Jan. 8, 1980 in the name of Harry Buchanan et al and assigned to the assignee of this invention, and reference may be made thereto for a more detailed description of the construction and operation of the mounting structure 18.

Figure 2:
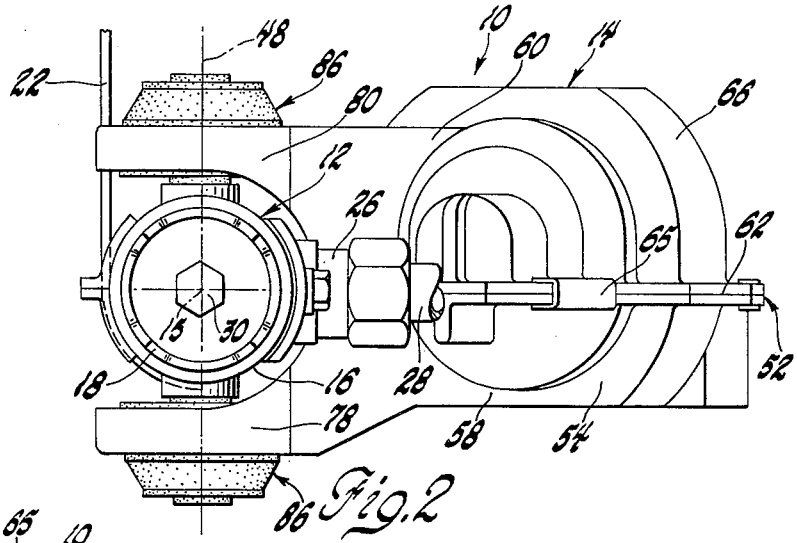
FIG. 2 is an enlarged view taken generally along the plane indicated by lines 2—2 in FIG. 1.

As seen best in FIGS. 1 and 2, the mast jacket assembly 12 further includes an electrical connector fitting 26 rigidly attached to the housing tube 16 and providing appropriate connection for an antenna cable 28. The cable 28 is electrically connected internally of the mast jacket assembly to a telescopically extendable antenna member, not shown, mounted within the housing tube 16 for movement between a fully retracted position disposed completely within the housing tube 16 and a fully extended signal receiving position projecting out of the upper end of the housing tube. Generally, the antenna member includes a plurality of successively smaller diameter tube sections nested within one another with means being provided to prevent escape of each tube from the next successively larger tube so that with all tubes extended a rigid, vertically extended antenna is provided. For retraction, the innermost tube section typically has fastened to the outermost end thereof a stopper, designated 30 in FIG. 2, which, as the center tube section is withdrawn, functions to pull each succeedingly larger tube section toward the fully retracted position until the entire antenna is disposed in the fully retracted position within the housing tube 16. An antenna structure of this type is shown in U.S. Pat. No. 3,253,799, issued May 31, 1966 in the name of R.J. Till and assigned to the assignee of this invention, and reference may be made thereto for a more complete description of the antenna structure. The housing tube 16 generally adjacent the lower end thereof has mounted internally an insulator bushing 32 having a large bore 34 therethrough lined with a metal collar 35 which functions as part of the electrical circuit between the cable 28 and the antenna structure. Immediately below the bushing 32 the housing tube 16 supports an electrically insulating, plastic guide bushing 36 having a small central guide aperture 38.

Figure 3:
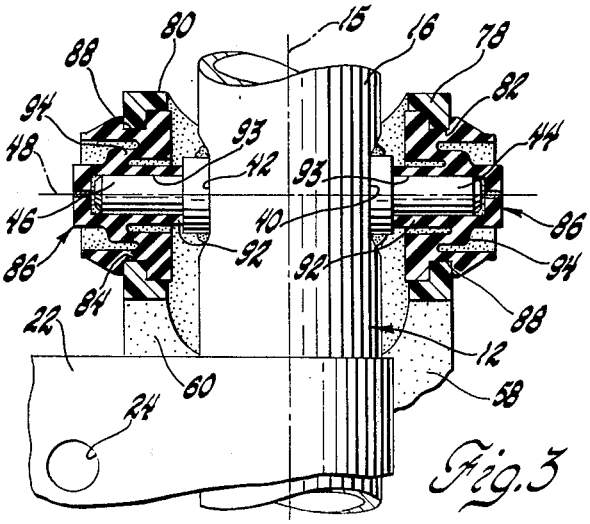
FIG. 3 is a partially broken away view taken generally along the plane indicated by lines 3—3 in FIG. 1 and showing the elastomeric grommets.

As seen best in FIGS. 1 and 3, the housing tube 16 is flattened slightly to provide a pair of diametrically opposed surfaces 40 and 42 in the area generally adjacent the lower circular opening 20 of the housing tube parallel to each other and to longitudinal axis 15. A mounting pin 44 is attached to the surface 40 by conventional means, as by welding, and projects perpendicular thereto. An identical mounting pin 46 is similarly rigidly attached to the surface 42 by conventional means and projects perpendicular thereto. The mounting pins 44 and 46 are disposed on a common transverse axis 48 of the mast jacket assembly 12 which axis is perpendicular to the longitudinal axis 15 of the mast jacket assembly.

Referring particularly now to FIGS. 1 and 2, the power actuator assembly 14 includes a generally L-shaped housing 52 having a vertical leg 54 and a horizontal leg 56. The housing 52 is an assembly made up of a left side shell half 58 and a right side shell half 60 which meet at a center or parting line 62 and are held together by conventional means, as for example rivets 64 and clips 65. Formed between the shell halves on the vertical leg 54 is a motor cavity 66 within which is mounted a conventional permanent magnet DC motor which drives a worm shaft 67 projecting downward toward the lower end of vertical leg 54. Also formed between the shell halves 58 and 60 on the vertical leg 54 is a switch cavity 68 within which is housed a reaction switch for controlling the motor in cavity 66. The reaction switch assembly is shown and described in U.S. Pat. No. 4,153,825, issued May 8, 1979 in the name of Raymond Flora and assigned to the assignee of this invention, and reference may be made thereto for a more detailed description of the structure and operation of the switch.

As seen best in FIG. 1, formed between shell halves 58 and 60 in the horizontal leg 56 of the housing is a drum and reel cavity in which is disposed a drum and reel assembly 70 including a cable drive and storage drum 71 having a worm gear 72 formed integrally on the circumference thereof. The worm gear 72 meshes with the worm shaft 67 so that rotation of the latter by the DC motor causes rotation of the drum 71. A flexible, pushpull type drive element 76 is wound around and attached at one end to the drum 71. The drive element projects out of the horizontal leg 56 generally immediately below the mast jacket, as described more fully hereinafter, and projects into the mast jacket assembly and is attached at its distal end, not shown, to the antenna member. The drum 71 functions when rotated by the worm shaft 67 through the worm gear 72 to extend or withdraw the flexible drive element 76 thereby to push the antenna member to the extended position or pull it to the retracted position within the housing tube 16. The drum and reel assembly 70 is shown and described in U.S. Pat. No. 4,181,268, issued Jan. 1, 1980 in the name of Carolus et al and assigned to the assignee of this invention, and reference may be made thereto for a more complete exposition of the details of the assembly.

Referring again to FIGS. 1, 2 and 3, left shell half 58 includes an integral support arm 78 and right shell half 60 includes a corresponding support arm 80 disposed in mirror image fashion with respect to support arm 78. The arms 78 and 80 straddle the housing tube 16 with mounting pin 44 projecting through a circular aperture 82 in arm 78 and mounting pin 46 projecting through a similar aperture 84 in arm 80. First isolation mounting means are provided in the form of a pair of identical elastomeric grommets 86 disposed between the support arms 78 and 80 and the mounting pins 44 and 46, respectively. The grommets 86 are disposed in mirror image fashion and each includes a circular groove 88 in which is received the edge of the corresponding one of the circular apertures 82 and 84 so that the grommets 86 are thereby fixedly attached to the support arms 78 and 80. Each grommet further includes a cylindrical section 92 having a bore 93, the section 92 being connected to the portion of the grommet defining the groove 88 by a flexible circular web 94. The grommets 86 are fabricated from an elastomeric material so that each cylindrical section 92 is resiliently suspended generally in the center of a corresponding one of the circular opening 82 and 84 in the support arms 78 and 80, respectively. Each bore 93 receives a respective one of the mounting pins 44 and 46 attached to the housing tube 16 so that the grommets function to mount the upper portion of the vertical leg 54 of the housing 52 on the mast assembly 12.

As noted, flexible webs 94 function to normally maintain the cylindrical sections 92 generally centered in the apertures 82 and 84. However, since the grommets are fabricated from resilient material, such as rubber or neoprene, limited displacement of the cylindrical sections 92, and hence the mounting pins 44 and 46 relative to the housing 52, is permitted toward the edges of the apertures 82 and 84. The webs 94, in spring-like fashion, resiliently resist such displacement so that, depending upon the characteristics of the particular material, displacement of the pins 44 and 46 relative to the housing 52 is resisted by a force proportional to that displacement. The particular characteristics of the grommet depend, of course, on the material chosen which choice is influenced by the degree of isolation desired, more isolation requiring greater flexibility in the web 94. The webs 94, while resiliently resisting displacement radially toward the edges of the apertures 82 and 84 are substantially more stiff with respect to displacement of the cylindrical sections 92 along the axis 48. Accordingly, the grommets function to effectively prevent shifting of the housing 52 laterally of the mast jacket assembly 12 along axis 48.

Figure 4:
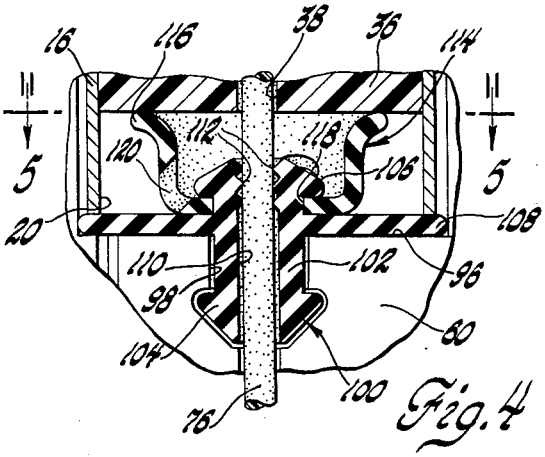
FIG. 4 is an enlarged view of a portion of FIG. 1 showing the elastomeric combination seal and grommet.
Figure 5:
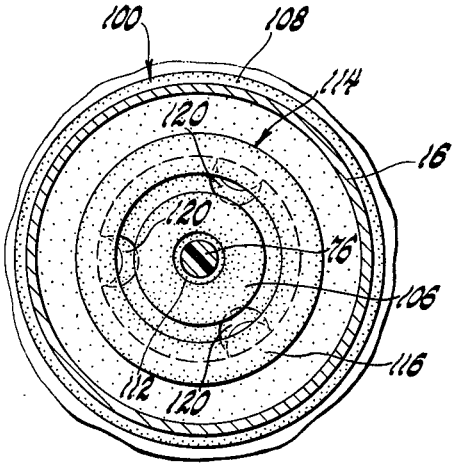
FIG. 5 is a view taken generally along the plane indicated by lines 5—5 in FIG. 4.

Referring now to FIGS. 1, 4 and 5, on the upper side of the distal end of horizontal leg 56 of the housing, the right side shell half 60 defines a semicircular horizontal shelf surface 96 immediately below but spaced from the circular opening 20 at the lower end of housing tube 16. A similar semicircular shelf surface, not shown, is formed on the shell half 58 which shelf surfaces cooperate in defining a circular platform, for a purpose to be described hereinafter, when the shell halves are joined together. Centrally of the semicircular horizontal shelf surface 96, the shell half 60 has formed therein one half, designated 98, of a cylindrical generally arrow-shaped cavity. The other half of the cavity, not shown, is molded into the left shell half 58 so that when the two shell halves are joined at assembly a complete cylindrical cavity disposed centrally of the circular shelf surface is defined.

Second isolation mounting means in the form of an elastomeric combination seal and grommet 100 is disposed in the cylindrical cavity between the shell halves 58 and 60. The combination seal and grommet 100 includes a cylindrical body portion 102 having an enlarged lower retaining head 104 and an enlarged upper retaining head 106. The combination seal and grommet 100 further includes a circular flange 108 integral with the body portion 102 and located between the retaining heads 104 and 106. A central bore 110 is formed within the body portion 102 and has a series of circular seal lips 112 located in the bore adjacent the upper retaining head 106. In the assembled condition, the combination seal and grommet 100 is dispposed within the cylindrical cavity formed between the shell halves 58 and 60 with the flange 108 abutting the circular shelf surface formed by the two shell halves and with the flexible drive element 76 being slidably received within the bore 110. The lower retaining head 104 of the combination seal and grommet prevents both withdrawal or further penetration of the seal and grommet into the housing while the lips 112 engage the drive element to resist penetration of moisture or soil from outside the housing into the interior of the housing in the area of drum and reel assembly 70.

A cup-shaped rubber boot 114 is provided between the flange 108 on the combination seal and grommet and the lower surface of the guide bushing 36. The rubber boot has an upper lip 116, an aperture 118 in the base thereof, and a plurality of drain holes 120 through the sides. In the assembled position, the aperture 118 is fitted over the body portion 102 of the combination seal and grommet and retained thereon by the upper retaining head 106. At the same time, the upper lip 116 engages the lower surface of the guide bushing 36 so that the exposed portion of the drive element 76 between the guide bushing 36 and the combination seal and grommet 100 is protected. Should moisture or soil or the like be stripped from the drive element 76 by the seal lips 112, escape for this material is allowed through the drain holes 120.

In operation, the upper portion of the power actuator assembly 14 is supported on the mast assembly 12 through the elastomeric grommets 86. The grommets 86 provide the primary support for the entire power actuator assembly 14 and resiliently resist any displacement of the support arms 78 and 80 relative to the mounting pins 44 and 46, respectively. The flexible drive element 76 projects out of the housing through the central bore 110 of the combination seal and grommet 100 which is rigidly retained on the housing as described hereinbefore. The grommet 100 being of elastomeric material and relatively stiffer than the grommets 86 resists lateral displacement of the flexible drive element relative to the housing. The drive element exits the combination seal and grommet 100 immediately below the central guide aperture 38 in the guide bushing 36 and then projects upward through the central aperture 38 for attachment to the antenna within the housing tube 16. Thus, while the lower end of the housing tube 16 is not directly connected to the housing 52, lateral displacement of the housing relative to the mast assembly results in engagement between the flexible drive element 76 and the edge of the guide aperture 38 in the guide bushing 36. The flexible element 76 possesses sufficient lateral rigidity over the short span between the guide bushing and the combination seal and grommet to resist displacement of the housing 52 relative to the housing tube 16. Accordingly, any tendency of the power actuator assembly 14 to rotate around the mounting pins 44 and 46 is resisted by the combination seal and grommet 100 in combination with the flexible drive element 76 and the guide bushing 36.

It will be apparent to those skilled in the art that the degree to which the power actuator assembly 14 is isolated from the mast jacket assembly is a function of the resiliency of the grommets 86 and the combination seal and grommet 100. This provides for flexibility of application where some body structures are more prone to vibration transmission than others. However, since it is desirable to prevent engagement between the lower end of the housing tube 16 and the housing 52, the resiliency of the grommets and the combination seal and grommet should be such as to prevent such contact under normal operating conditions.

The embodiments of the invention in which an exclusive property or privilege is claimed are defined as follows:

1. In a power operated antenna installation including a tubular antenna mast jacket disposed vertically and rigidly attached to a support structure, telescoping antenna means disposed on the longitudinal axis of said mast jacket for movement between an extended signal reception position and a retracted position within said mast jacket, power actuator means including a generally L-shaped housing portion having a first leg disposed parallel to said mast jacket and supporting thereon electric motor drive means and a second leg disposed below said mast jacket and supporting thereon a reel and storage means operable by said electric motor means, flexible drive means operative to transmit force in tension and in compression projecting into the lower end of said mast jacket and connected at one end to said antenna means and projecting into said housing portion immediately below said mast jacket for connection at the other end to said reel and storage means whereby said reel and storage means applies tension and compression on said flexible drive means to effect bodily shiftable movement thereof and consequent movement of said antenna means between said extended and said retracted positions, and a guide bushing on said mast jacket adjacent the lower end thereof engaging said flexible drive means and operative to center said drive means on the longitudinal axis of said mast jacket while simultaneously resisting lateral displacement of said flexible drive means relative to said mast jacket, in said antenna installation the improvement comprising, a pair of mounting pins rigidly attached to said mast jacket and aligned on a transverse axis thereof, a pair of support arms rigidly attached to said housing portion generally adjacent the upper end of said first leg and straddling said mast jacket, a pair of elastomeric grommets disposed between respective ones of said support arms and corresponding ones of said mounting pins, said grommets providing primary resilient support for said housing portion on said mast jacket by permitting controlled displacement of said housing portion relative to said mast jacket in resilient fashion whereby displacement is resisted by forces proportional to displacement, an elastomeric combination seal and grommet disposed on said second leg generally immediately below said mast jacket and slidably and sealingly receiving said flexible drive means, said combination seal and grommet being relatively stiffer than said elastomeric grommets and operative to resist displacement of said second leg laterally of said flexible drive means in resilient fashion whereby resistance is proportional to displacement, said flexible drive means and said guide bushing in close proximity to said combination seal and grommet cooperating to resist lateral displacement of said second leg of said housing portion relative to said mast jacket.

2. In a power operated antenna installation including a tubular mast jacket disposed vertically and rigidly attached to a support structure, telescoping antenna means disposed on the longitudinal axis of said mast jacket for movement between an extended signal reception position and a retracted position within said mast jacket, power actuator means including a generally L-shaped housing portion having a first leg disposed parallel to said mast jacket and a second leg disposed below said mast jacket, flexible drive means operative to transmit force in tension and in compression projecting into the lower end of said mast jacket and connected at one end to said antenna means and projecting into said housing portion immediately below said mast jacket for connection at the other end to said actuator means whereby said actuator means applies tension and compression on said flexible drive means to effect bodily shiftable movement thereof and consequent movement of said antenna means between said extended and said retracted positions, and guide means disposed between said flexible drive means and said mast jacket adjacent the lower end of the latter operative to resist lateral displacement of said flexible drive means relative to said mast jacket, in said antenna installation the improvement comprising, first elastomeric support means disposed between said first leg of said housing portion generally at an end thereof and said mast jacket at a location on the latter intermediate the ends thereof, said first support means providing primary resilient support for said housing portion on said mast jacket and permitting controlled displacement of said housing portion relative to said mast jacket in resilient fashion whereby displacement is resisted by forces proportional to displacement, and second elastomeric support means disposed between said flexible drive means and said second leg of said housing portion generally adjacent said guide means, said second support means being relatively stiffer than said first support means and operative to resist relative lateral displacement between said housing portion and said flexible drive means in resilient fashion whereby resistance is proportional to displacement, said flexible drive means and said guide means in close proximity to said second support means cooperating to resist lateral displacement of said second leg of said housing portion relative to said mast jacket.

3. In a power operated antenna installation including an antenna mast jacket rigidly attached to a support structure, antenna means disposed on said mast jacket for movement between an extended signal reception position and a retracted position, power actuator means including a housing portion, flexible drive means operative to transmit force in tension and in compression connected at one end to said antenna means and projecting into said housing portion for connection at the other end to said actuator means whereby said actuator means applies tension and compression on said flexible drive means to effect bodily shiftable movement thereof and consequent movement of said antenna means between said extended and said retracted positions, and guide means disposed between said flexible drive means and said mast jacket adjacent an end of the latter operative to resist lateral displacement of said flexible drive means relative to said mast jacket, in said antenna installation the improvement comprising, first elastomeric support means disposed between said housing portion and said mast jacket at a location on the latter intermediate the ends thereof, said first support means permitting controlled displacement of said housing portion relative to said mast jacket in resilient fashion whereby displacement is resisted by forces proportional to displacement, and second elastomeric support means disposed between said flexible drive means and said housing portion generally adjacent said guide means, said second support means being relatively stiffer than said first support means and operative to resist relative lateral displacement between said housing portion and said flexible drive means in resilient fashion whereby resistance is proportional to displacement and said flexible drive means and said guide means in close proximity to said second support means cooperating to resist lateral displacement of said housing portion relative to said mast jacket.

* * * * *